US005275873A

United States Patent [19]

Chitrangad

[11] Patent Number: 5,275,873

[45] Date of Patent: Jan. 4, 1994

[54] BALLISTIC STRUCTURE

[75] Inventor: Chitrangad, Midlothian, Va.

[73] Assignee: E. I. Du Pont de Nemours and Company, Wilmington, Del.

[21] Appl. No.: 990,784

[22] Filed: Dec. 10, 1992

[51] Int. Cl.[5] ..... D03D 3/00

[52] U.S. Cl. ..... 428/229; 2/2.5; 428/225; 428/257; 428/902; 428/911

[58] Field of Search ..... 428/225, 902, 911, 229, 428/257; 2/2.5

[56] References Cited

U.S. PATENT DOCUMENTS

| | | | |
|---|---|---|---|
| 4,574,105 | 3/1986 | Donovan | 428/233 |
| 4,850,050 | 7/1989 | Droste et al. | 2/2.5 |
| 5,114,653 | 5/1992 | Schuerhoff | 428/395 |
| 5,120,599 | 6/1992 | Lewis | 428/298 |
| 5,124,196 | 6/1992 | Figge | 428/246 |

FOREIGN PATENT DOCUMENTS 264666 9/1976 U.S.S.R. .

*Primary Examiner*—James J. Bell

[57] ABSTRACT

An improved ballistic structure is disclosed wherein aramid filaments of the structure are maintained under tension.

9 Claims, 1 Drawing Sheet

BALLISTIC STRUCTURE

BACKGROUND OF THE INVENTION

1. Field of the Invention

This invention relates to ballistic structures and particularly to ballistic structures which include high tenacity continuous filament yarns.

2. Description of the Prior Art

U.S. Pat. No. 4,574,105, issued Mar. 4, 1986 on the application of J. G. Donovan, discloses a ballistic structure of woven aramid yarn plies in combination with nonwoven plies. There is no suggestion of placing any of the plies under tension.

U.S. Pat. No. 5,114,653, issued May 19, 1992 on the application of Schuerhoff et al., discloses cast prestressed concrete reinforced by yarns of continuous individual, parallel, filaments under tension embedded in a matrix of resin, in turn, embedded in the concrete.

SUMMARY OF THE INVENTION

The present invention provides a ballistic structure comprising at least one layer of a fabric including high tenacity continuous filament yarns wherein continuous filaments in the structure are under tension of at least 0.01 grams/dtex.

DETAILED DESCRIPTION OF THE INVENTION

Figure 1:
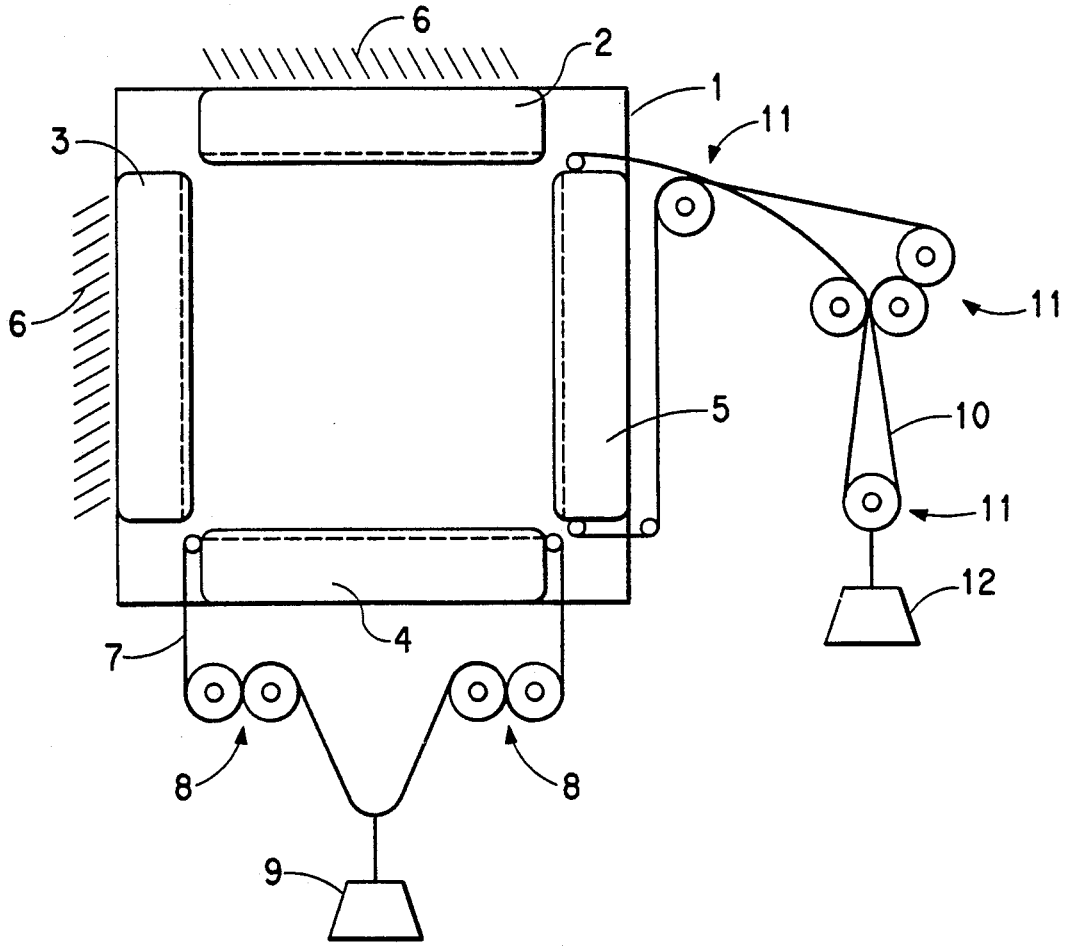
FIG. 1 is a schematic representation of a ballistic structure of this invention under tension.

The ballistic structures of this invention are intended to be both soft structures incorporating fabrics or other ballistic yarns without matrix resins or rigid supports, and composite or rigid ballistic structures in which the ballistic yarns are affixed in matrix resins.

Fabrics which are eligible for use in the present invention can be any of several types, including: unidirectional, in which all yarns are ballistic fibers are substantially parallel and are not woven. In such a unidirectional structure, there may be a few cross-directional yarns provided to maintain alignment of the unidirectional elements. Fabrics of the present invention can also be made from a nonwoven bidirectional alignment of ballistic yarns wherein the fabric includes at least two layers of unidirectional yarns, one of those layers being at an orientation of 90 degrees from the other. In practice of the present invention, one or both of the bidirectional layers can be under tension. A third type of fabric which can be used in the present invention is a woven configuration wherein the warp yarns or the fill yarns, or both, can be ballistic yarns; and, for purposes of this invention, the warp yarns or the fill yarns, or both, can be under tension.

Yarns which are used in the present invention should be continuous filament yarns of high tenacity and high elongation. Known ballistic yarns are aramids such as poly(p-phenylene terephthalamide) (PPD-T), copolymers of aramids and PPD-T, nylon, poly(vinyl alcohol), and highly oriented polyethylene.

Filaments used in yarns in the construction of the present invention should exhibit a tenacity of at least 12 gram/dtex and an elongation at break of at least 2.2%. Yarn dtex (linear density), while not critically important to practice of the present invention, is generally from 55 to 3300. Filament dtex is generally from less than 1 to as much as 10.0. Yarns can be twisted or not, as desired or required for a particular use. If twisted, yarns are generally twisted at a rate of from 0.5 to 3.0 turns per centimeter.

Tension can be applied to the filaments in the structure of this invention either in an active manner or passively. By "active" is meant that tension is applied to filaments in the structure by application of tension forces directly on the filaments in the ballistic structure itself. By "passive" is meant that tension is applied to the filaments during impregnation of the filaments in a polymeric matrix and during curing of the polymer in that matrix. After curing of the polymer matrix, tension forces can be released and the tension maintained by being held in the polymer matrix. Tension on the filaments, in practice of this invention, should be from 0.01 to 1.0 grams/dtex. The degree of tension to be applied to filaments in the ballistic structure of this invention is not critical because any degree of tension will provide some improvement. Lower degrees of tension provide lesser improvement and degrees of tension greater than that indicated in the range above are practically difficult to apply and maintain.

Yarns in a ballistic structure under passive tension should be built into the structure at a relatively high degree of tension because an appropriate level of residual tension is difficult to maintain even when the matrix resin is strongly adhered to the filaments. If passive tension is to be used to make ballistic structures of this invention, care should be used to provide matrix systems with particularly good adhesion to the filaments. Matrix polymers should be epoxy resins, phenolic resins, polyimide resins, polyesters, and the like.

TEST METHODS

Tensile Properties. Yarns tested for tensile properties are, first, conditioned and, then, twisted to a twist multiplier of 1.1. The twist multiplier (TM) of a yarn is defined as:

$$TM = (\text{twists/inch})/(5315/\text{denier of yarn})^{-\frac{1}{2}}$$

The yarns to be tested are conditioned at 25° C., 55% relative humidity for a minimum of 14 hours and the tensile tests are conducted at those conditions. Tenacity (breaking tenacity), elongation (breaking elontation), and modulus are determined by breaking test yarns on an Instron tester (Instron Engineering Corp., Canton, Mass.).

Tenacity, elongation, and initial modulus, as defined in ASTM D2101-1985, are determined using yarn gage lengths of 25.4 cm and an elongation rate of 50% strain/minute. The modulus is calculated from the slope of the stress-strain curve at 1% strain and is equal to the stress in grams at 1% strain (absolute) times 100, divided by the test yarn dtex.

Dtex. The dtex of a yarn is determined by weighing a known length of the yarn. Dtex is defined as the weight, in grams, of 10,000 meters of the yarn.

In actual practice, the measured dtex of a yarn sample, test conditions and sample identification are fed into a computer before the start of a test; the computer records the load-elongation curve of the yarn as it is broken and then calculates the properties.

Ballistic Limit. Ballistic tests are conducted in accordance with MIL-STD-662e as follows: A lay-up to be tested is placed in a sample mount to hold the lay-up in the desired degree of tension and perpendicular to the path of test projectiles. The projectiles are 17-grain fragment simulating projectiles (MIL-P-46593), except where indicated otherwise, and are propelled from a test barrel capable of firing the projectiles at different velocities. The first firing for each lay-up is for a projectile velocity estimated to be the likely ballistic limit ($V_{50}$). When the first firing yields a complete lay-up penetration, the next firing is for a projectile velocity of about 50 feet per second less in order to obtain a partial penetration of the lay-up. On the other hand, when the first firing yields no penetration or partial penetration, the next firing is for a velocity of about 50 feet per second more in order to obtain a complete penetration. After obtaining one partial and one complete projectile penetration, subsequent velocity increases or decreases of about 50 feet per second are used until enough firings are made to determine the ballistic limit ($V_{50}$) for that lay-up.

The ballistic limit ($V_{50}$) is calculated by finding the arithmetic mean of an equal number of three of the highest partial penetration impact velocities and three of the lowest complete penetration impact velocities, provided that there is not more than 125 feet per second between the highest and lowest individual impact velocities.

DESCRIPTION OF THE PREFERRED EMBODIMENTS

In the examples which follow, various structures made from para-aramid yarns have been placed under tension and subjected to ballistics tests. In each case, a control test was conducted wherein the same structure was tested ballistically but was not under tension.

Referring to the Figure, ballistic structure 1 is held by clamps 2, 3, 4, 5. Clamps 2 and 3 are mounted in a static foundation 6 and clamps 4 and 5 are attached to tension means. Cord 7 runs through clamp 4, onto pulleys 8, and over to tension weight 9. Cord 10 runs through clamp 5, onto pulleys 11, and down to tension weight 12.

EXAMPLE 1

For this example, 2 plies of a fabric made from 1667 dtex yarns of poly(p-phenylene terephthalamide) sold by E. I. du Pont de Nemours and Company under the trade designation Kevlar® 29, woven into a 2×2 basket weave 13.8×13.4 ends per cm, were subjected to the ballistics test described previously. The areal density for the 2 ply ballistic structure of this example was 948 grams per square meter. Tension was applied in both the warp and the fill directions to an extent of about 0.018 grams per dtex. The $V_{50}$ for the ballistic structure under tension was 299 meters per second which represents a 7 percent increase over the 279 meters per second which was found to be the $V_{50}$ for the same fabric tested under no tension.

EXAMPLE 2

In this example, three plies of the same fabric as was used in Example 1 were subjected to ballistics tests. The areal density was 1422 grams per square meter. The tension was applied in both the warp and the fill directions and was 0.012 grams per dtex. The $V_{50}$ for the ballistic structure of this invention was 330 meters per second which represents an 8 percent increase over 305 meters per second for the $V_{50}$ of the control.

EXAMPLE 3

In this example, five plies of a fabric woven in plain weave from 833 dtex yarn 11.0×10.2 ends per centimeter were subjected to ballistics tests. The warp yarn in this fabric was PPD-T sold by E. I. du Pont de Nemours and Company under the trade designation Kevlar® 129; and the fill yarn in this fabric was PPD-T sold by E. I. du Pont de Nemours and Company under the trade designation Kevlar® 29. The areal density was 1104 grams per square meter. The tension applied to the ballistic structure of this invention was 0.018 grams per dtex in both the warp and the fill directions. The $V_{50}$ for the ballistic structure of this invention was 340 meters per second which represents a 23 percent increase over the 276 meters per second $V_{50}$ for the same structure tested without tension.

The structures of this invention find use in such various applications as foxhole covers, riot shields, portable shelters, mobile transporter covers, and the like.

I claim:

1. A ballistic structure comprising at least one layer of a woven fabric including high tenacity continuous filament yarns wherein continuous filaments in the structure are under a tension of at least 0.01 grams per dtex.

2. The structure of claim 1 wherein the continuous filament yarns are present in the fabric as both, warp and fill yarns.

3. The structure of claim 2 wherein both the warp and fill yarns are under a tension of at least 0.01 grams per dtex.

4. The structure of claim 2 wherein the warp yarns are under a tension of at least 0.01 grams per dtex.

5. The structure of claim 2 wherein the fill yarns are under a tension of at least 0.01 grams per dtex.

6. The structure of claim 1 wherein the continuous filament yarns are aramid yarns.

7. The structure of claim 6 wherein the aramid yarns are poly(p-phenylene terephthalamide).

8. A ballistic structure comprising at least one layer of a woven fabric including high tenacity continuous filament yarns wherein continuous filaments in the structure are under an active tension of at least 0.01 grams per dtex.

9. A ballistic structure comprising at least one layer of a woven fabric including high tenacity continuous filament yarns wherein continuous filaments in the structure are under a tension of at least 0.01 grams per dtex applied to filaments in the structure by application of tension forces directly on the filaments in the ballistic structure itself.

* * * * *